US007263828B2

(12) United States Patent
Iwanami et al.

(10) Patent No.: US 7,263,828 B2
(45) Date of Patent: Sep. 4, 2007

(54) FLUID MACHINE

(75) Inventors: Shigeki Iwanami, Okazaki (JP); Hironori Asa, Okazaki (JP); Keiichi Uno, Kariya (JP); Yasuhiro Takeuchi, Kariya (JP); Hiroshi Ogawa, Nagoya (JP)

(73) Assignees: DENSO Corporation, Kariya (JP); Nippon Soken, Inc., Nishio (JP)

( * ) Notice: Subject to any disclaimer, the term of this patent is extended or adjusted under 35 U.S.C. 154(b) by 80 days.

(21) Appl. No.: 11/063,879

(22) Filed: Feb. 24, 2005

(65) Prior Publication Data

US 2005/0193734 A1 Sep. 8, 2005

(30) Foreign Application Priority Data

Mar. 3, 2004 (JP) ..... 2004-059528

(51) Int. Cl.
*F25B 9/06* (2006.01)
*F02G 5/00* (2006.01)
*B60H 1/32* (2006.01)

(52) U.S. Cl. ..... 60/414; 290/43; 418/55.1

(58) Field of Classification Search ..... 60/413, 60/414, 657; 62/402; 290/43; 417/374; 418/55.1

See application file for complete search history.

(56) References Cited

U.S. PATENT DOCUMENTS

| | | | | |
|---|---|---|---|---|
| 4,326,391 | A | 4/1982 | Sato et al. | |
| 5,121,607 | A * | 6/1992 | George, Jr. | 60/712 |
| 6,443,712 | B2 | 9/2002 | Sakai et al. | |
| 6,725,581 | B2 * | 4/2004 | Naruse et al. | 60/414 |
| 2004/0184923 | A1 * | 9/2004 | Iwanami et al. | 417/221 |

FOREIGN PATENT DOCUMENTS

JP B2-2540738 7/1996

OTHER PUBLICATIONS

First Office Action from Chinese Patent Office issued on Jun. 2, 2006 for the corresponding Chinese patent application No. 200510052699.7 (a copy and English translation thereof).

* cited by examiner

*Primary Examiner*—Thomas E. Lazo
(74) *Attorney, Agent, or Firm*—Posz Law Group, PLC

(57) ABSTRACT

An expansion-and-compressor device of a fluid machine has a pump mode operation in which the expansion-and-compressor device is rotated by a driving force from a driving source to compress working fluid, and a motor mode operation in which the fluid pressure is converted into energy of movement to output kinetic energy. The fluid machine further has a transmission device for transmitting the driving force from the driving source with increased rotational speed, when the expansion-and-compressor device is operated in the pump mode operation.

10 Claims, 3 Drawing Sheets

FLUID MACHINE

CROSS REFERENCE TO RELATED APPLICATION

This application is based on Japanese Patent Application No. 2004-59528 filed on Mar. 3, 2004, the disclosure of which is incorporated herein by reference.

FIELD OF THE INVENTION

The present invention relates to a fluid machine having a pump mode operation for pressurizing and discharging fluid and a motor mode operation for converting fluid pressure during fluid expansion into energy of movement and for outputting kinetic energy, wherein the fluid machine is preferably used as an expansion-and-compressor device for a waste heat collecting system having Rankine cycle for collecting heat energy

BACKGROUND OF THE INVENTION

In a prior art fluid machine, as disclosed, for example, in Japanese Patent No. 2540738, a compressor device for a vapor compression refrigerating system is commonly used as an expansion device, and the compressor device is used as the expansion device when energy is collected by Rankine cycle.

In the above fluid machine, in which the expansion device and the compressor device are commonly used, the capacity for the fluid machine is generally set to such an amount necessary for the compressor device on the condition that the refrigerating cycle is efficiently operated. As a result, the capacity for the fluid machine as the expansion device is inevitably decided by such amount. Accordingly, the design flexibility for the expansion device is reduced and an optimum efficiency of the fluid machine for collecting the waste heat can be hardly obtained.

For example, the pressure of the refrigerant in the operation of the Rankine cycle is higher than that in the operation of the refrigerating cycle, a volumetric flow rate for the operation of Rankine cycle becomes smaller than that for the refrigerating cycle, even if the amount (weight) of the refrigerant is the same. Then, a rotational speed of the fluid machine becomes lower when it is operated as the expansion device, an influence of refrigerant leak per revolution would become larger (leak speed becomes higher than expansion speed), and thereby the efficiency of the expansion device is decreased.

SUMMARY OF THE INVENTION

It is, therefore, an object of the present invention, in view of the above mentioned problems, to provide a fluid machine which can not only satisfy a performance for a pump mode operation but also improve its efficiency for a motor mode operation, wherein the fluid machine has the pump mode operation for pressurizing and discharging fluid and the motor mode operation for converting fluid pressure during fluid expansion into energy of movement and for outputting kinetic energy.

According to a feature of the present invention, a fluid machine comprises an expansion-and-compressor device, which has a pump mode operation in which fluid is pressurized by a rotational force from a driving source and a motor mode operation in which fluid pressure is converted into energy of movement during fluid expansion and kinetic energy is outputted. The fluid machine further comprises a transmission device for transmitting the rotational force from the driving source to the expansion-and-compressor device with an increased rotational speed in the pump mode operation.

In the above fluid machine, a volume of the working chambers of the expansion-and-compressor device is designed to be made smaller so that the expansion-and-compressor device can be operated in an optimum condition to effectively output the kinetic energy, even when volumetric flow rate is decreased due to a higher operating pressure in the motor mode operation than an operating pressure in the pump mode operation. In the case that the volume of the working chambers is reduced as above, a sufficient refrigerating operation may not be obtained when the expansion-and-compressor device is operated as the compressor device in the pump mode operation. Such a decrease of the performance of the refrigerating operation (the pump mode operation), however, can be avoided by driving the compressor device at a higher rotational speed.

According to the above feature, therefore, since the necessary discharge amount of the compressed refrigerant during the pump mode operation can be obtained by the increased rotational speed, even when the capacity per revolution of the expansion-and-compressor device is set to a smaller amount. As a result, since the expansion-and-compressor device can be operated with the capacity suitable for the volumetric flow rate of the refrigerant in the motor mode operation, the decrease of the rotational speed can be avoided and thereby the influence of the leak per revolution can be reduced (by making the expansion speed higher than the leak speed of the refrigerant) to finally improve the operational efficiency of the fluid machine.

Accordingly, the fluid machine can not only satisfy a performance for the pump mode operation but also improve its efficiency for the motor mode operation.

According to another feature of the present invention, the driving source is preferably an outside source, such as an internal combustion engine.

According to a further feature of the present invention, a regenerating device, such as an electric power generator, is provided for converting the kinetic energy into an energy in a preferable or desired form, when the fluid machine is operated in the motor mode operation.

According to a still further feature of the present invention, the expansion-and-compressor device, the transmission device and the electric rotating device are arranged on the same axis, or those components are integrally housed. And thereby, the fluid machine 10 can be made in a small-size construction.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

First Embodiment

A first embodiment of the present invention will now be explained with reference to FIGS. 1 through 3. A fluid machine of the present invention is used to, for example, a motor vehicle, which is equipped with an air-conditioning system and a waste heat utilizing system. The waste heat utilizing system is composed of a Rankine cycle, which collects waste heat from an internal combustion engine generating a driving power for the motor vehicle. In addition, in the fluid machine of the present invention, the heat (heating or cooling energy) generated by the fluid machine is utilized to perform an air-conditioning operation for the motor vehicle.

Figure 1:
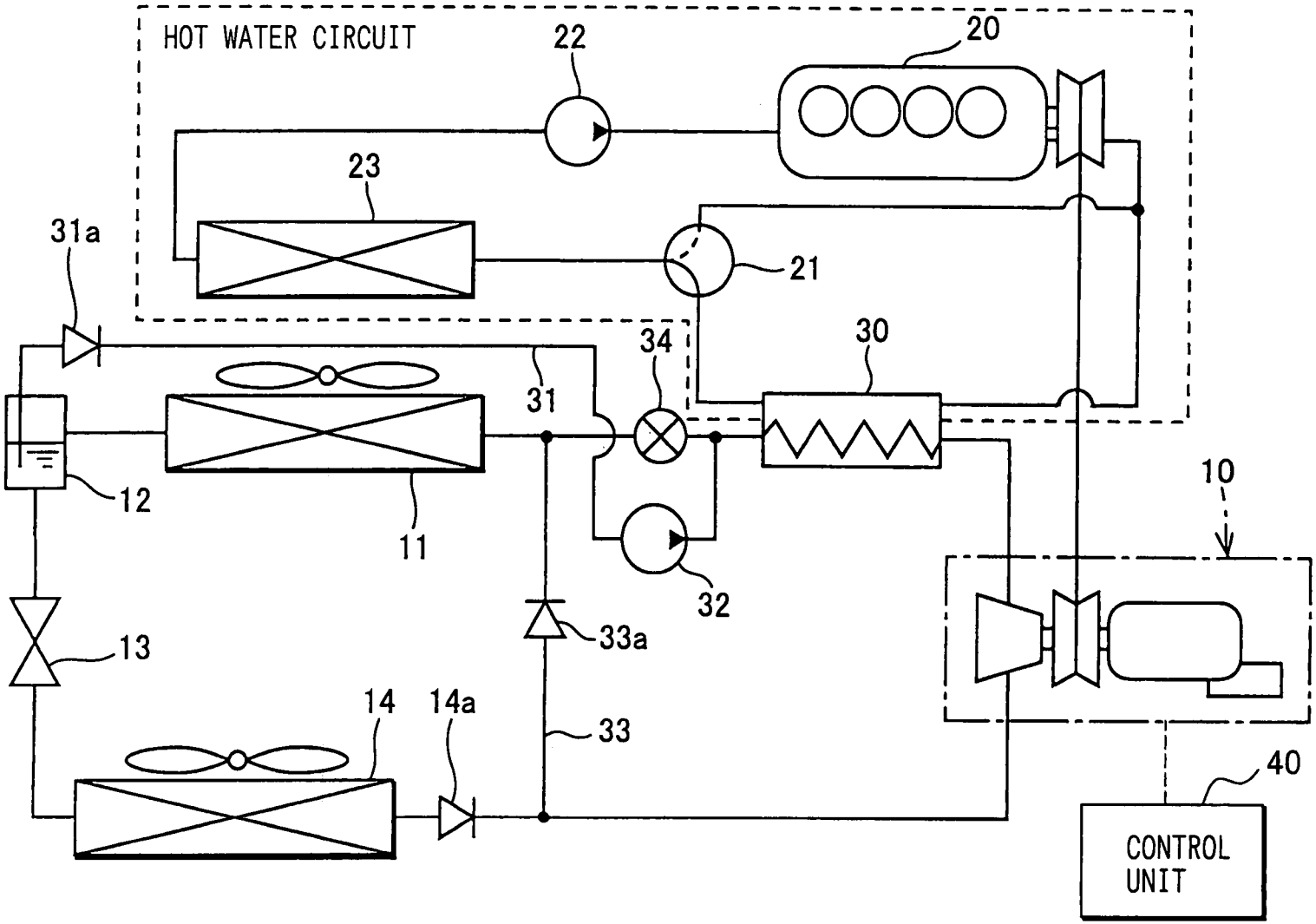
FIG. 1 is a schematic diagram showing a refrigerating cycle and a waste heat collecting cycle to which a fluid machine according to the present invention is applied.
Figure 2:
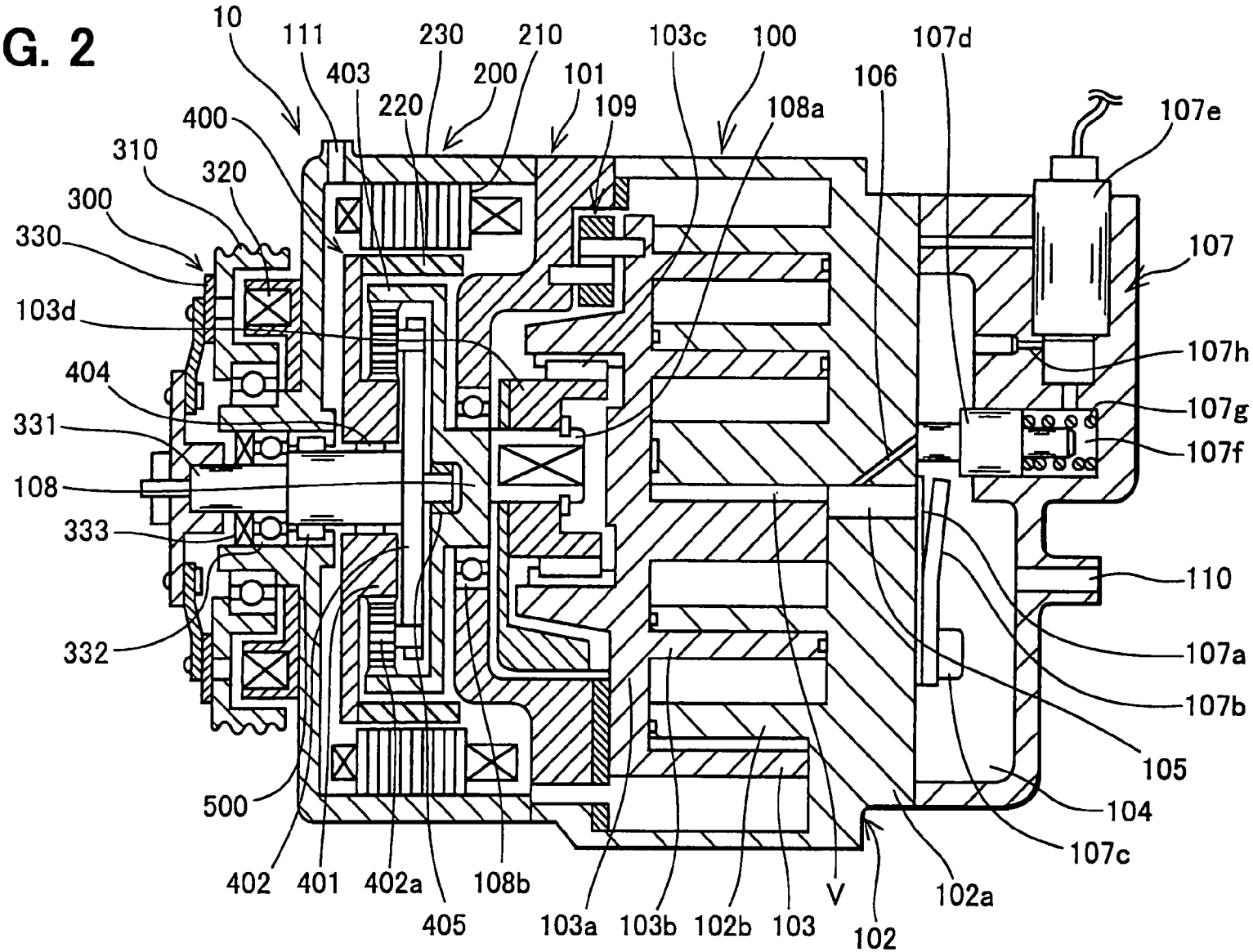
FIG. 2 is a cross-sectional view of a fluid machine according to a first embodiment of the present invention.

In FIG. 1, a reference numeral 10 designates a fluid machine comprising an expansion-and-compressor device, so that the fluid machine operates as a compressor for compressing a gas-phase. refrigerant (this is referred to as a pump mode operation) and also as a power generator for generating a mechanical driving force by converting fluid pressure of superheated steam into kinetic energy (this is referred to as a motor mode operation). A reference numeral 11 designates a heat radiating device connected to an outlet side (a high pressure port 110 described later) of the fluid machine 10 for cooling down the refrigerant gas by heat radiation (The heat radiating device 11 will be also referred to as a condenser).

A reference numeral 12 designates a receiver for dividing the refrigerant from the condenser 11 into a gas-phase refrigerant and a liquid-phase refrigerant. A reference numeral 13 is an expansion valve of a temperature-dependant type for expanding and decreasing the pressure of the liquid-phase refrigerant from the receiver 12, more particularly for decreasing the pressure of the refrigerant in an isenthalpic manner and controlling an opening degree of a passage for the refrigerant so that the degree of superheat of the refrigerant to be sucked into the fluid machine 10 will be maintained at a predetermined value when the fluid machine 10 is operating in the pump mode operation.

A reference numeral 14 designates a heat absorbing device (also referred to as an evaporator) for evaporating the depressurized refrigerant from the expansion valve 13 and thereby absorbing heat. The above fluid machine 10, the condenser 11, the receiver 12, the expansion valve 13 and the evaporator 14 constitute a refrigerating cycle, for transmitting the heat from a low temperature side to a high temperature side.

A heating device 30 is disposed in a refrigerant passage connected between the fluid machine 10 and the condenser 11 and heats the refrigerant flowing through the refrigerant passage by heat-exchanging the refrigerant with engine cooling water flowing through the heating device 30. A switching valve 21 of a three-way valve is provided in a circuit for the engine cooling water (a hot water circuit), so that the flow of the cooling water through the heating device 30 is switched on and off. The switching valve 21 is controlled by an electronic control unit 40.

A first bypass passage 31 is connected between the receiver 12 (gas-liquid separator) and the heating device 30, so that the liquid-phase refrigerant will flow from the receiver 12 to an inlet side of the heating device 30 when a liquid pump 32 is operated. A check valve 31*a* is provided in this first bypass passage 31 in order that only the flow of the refrigerant from the receiver 12 to the heating device 30 is allowed. The liquid pump 32 in this embodiment is an electrically driven pump and controlled by the electronic control unit 40.

A second bypass passage 33 is connected between an outlet side of the fluid machine 10 (a low pressure port 111 described later) when it is operating in a motor mode and the inlet side of the condenser 11 and a check valve 33*a* is disposed in this bypass passage 33, so that the refrigerant is allowed to flow from the fluid machine 10 to the condenser 11, only when the fluid machine 10 is operated in the motor mode operation.

A check valve 14*a* is provided in the refrigerating cycle so that the refrigerant is allowed to flow from the outlet side of the evaporator 14 to the inlet side (the low pressure port 111) of the fluid machine 10 when the fluid machine 10 is operated in the pump mode operation. An ON-OFF valve 34 is an electromagnetic type for opening and closing the passage for the refrigerant passage, and is controlled by the electronic control unit 40.

A water pump 22 circulates the engine cooling water, and a radiator 23 is a heat exchanger for heat exchanging the heat of the engine cooling water with the ambient air to cool down the engine cooling water. The water pump 22 is a mechanical type pump driven by the engine 20 in this embodiment. It is, however, possible to replace it with an electric type pump operated by an electric motor. A bypass passage for bypassing the radiator 23 and a flow rate control valve for controlling an amount of the engine cooling water flowing through the radiator 23 are omitted in FIG. 1.

Now, the fluid machine 10 will be explained with reference to FIG. 2. The fluid machine 10 according to the embodiment comprises the expansion-and-compressor device 100 for selectively expanding or compressing the refrigerant (the gas-phase refrigerant in this embodiment), an electric rotating device 200 for generating an electric power when a rotational force is applied thereto and for generating a rotational force when the electric power is applied thereto, an electromagnetic clutch 300 for controlling (switching on and off) a drive train of a rotational force from the engine 20 to the expansion-and-compressor device 100, and a transmission device 400 comprising a planetary gear drive for changing a path for the drive train among the expansion-and-compressor device 100, the electric rotating device 200 and the electromagnetic clutch 300 and for increasing and decreasing the rotational speed to be transmitted.

The electric rotating device 200 comprises a stator 210 and a rotor 220 rotating within a space of the stator 210, wherein a winding is wound on the stator 210 and a permanent magnet is fixed to the rotor 220.

When the electric power is supplied to the stator 210, the rotor 220 will be rotated to operate as an electric motor so that it drives the expansion-and-compressor device 100, whereas it will operate as an electric power generator when a rotational force is applied to the rotor 220.

The electromagnetic clutch 300 comprises a pulley 310 to be connected to the engine 20 via a V-belt, an electromagnetic coil 320 and a friction plate 330 which will be displaced by an electromagnetic force generated at the electromagnetic coil 320 when it is energized. The coil 320 will be energized when the rotational force from the engine 20 will be transmitted to the fluid machine 10, and the supply of the electric power to the coil 320 will be cut off when the transmission of the rotational force shall be cut off.

The expansion-and-compressor device 100 has the same construction to a well known scroll type compressor, and comprises a middle housing 101 fixed to a stator housing 230 of the electric rotating device 200, a fixed scroll 102 connected to the middle housing 101, and a movable scroll 103 disposed in a space defined by the middle housing 101 and the fixed scroll 102. The movable scroll 103 is rotated in the space with an orbit motion to form multiple working chambers V. The device 100 further comprises a high pressure chamber 104, passages 105 and 106 operatively communicating the working chamber V with the high pressure chamber 104, and a valve mechanism 107 for controlling an opening and closing of the passages 105, 106.

The fixed scroll 102 comprises a base plate 102*a* and a spiral scroll wrap 102*b* protruding from the base plate 102*a* towards the middle housing 101, whereas the movable scroll likewise has a base plate 103*a* and a spiral scroll wrap 103*b* protruding from the base plate 103*a* towards the fixed scroll, wherein wall portions of the spiral scroll wraps 102*b* and 103*b* are contacted with each other to form the working chambers V. When the movable scroll 103 is rotated, the space of the working chamber V will be expanded or decreased.

A shaft 108 is rotationally supported by the middle housing 101 and provided with a ring gear 403, which is a part of the transmission device 400. The shaft 108 is further provided with an eccentric shaft 108*a* which is eccentric from a rotational axis of the shaft 108 to operate as a crank arm and operatively connected to the movable scroll 103 over a bush 103*d* and a bearing 103*c*.

The bush 103*d* is connected to the eccentric shaft 108*a* in such a way that the bush 103*d* is displaced by a certain small distance in a plain perpendicular to the axis of the eccentric shaft 108*a*, so that the movable scroll 103 will be displaced in a direction that contact pressure between the scroll wraps 102*b* and 103*b* will be increased by means of a reaction force for compression.

A reference numeral 109 designates an autorotation preventing mechanism for preventing the autorotation of the movable scroll 103 and allowing the orbital motion thereof. When the shaft 108 is rotated by one revolution, the movable scroll 103 is moved around the shaft 108 with the orbital motion, and the volume of the working chamber V will be decreased as the working chamber is moved from the outer position to the inner position. The mechanism 109 here comprises a ring and a pair of pins.

The passage 105 operates as an outlet port for pumping out the pressurized refrigerant by communicating the working chamber V, which will reach its minimum volume during the pump mode operation, with the high pressure chamber 104, whereas the passage 106 operates an inlet port for introducing high-temperature and high-pressure refrigerant, namely superheated steam of the refrigerant, from the high pressure chamber 104 into the working chamber V, the volume of which becomes at its minimum value during the motor mode operation.

The high pressure chamber 104 has a function of equalizing the pressure of the refrigerant by smoothing pulsation of the pumped out refrigerant through the passage 105 (also referred to as a discharge port 105). The high pressure port 110 is formed in a housing forming the high pressure chamber 104 and the high pressure port 110 is connected to the heating device 30 and the heat radiating device 11.

The low pressure port 111 is formed in the stator housing 230 for communicating a space defined by the stator housing 230 and the fixed scroll 102 with the evaporator 14 and the second bypass passage 33.

A discharge valve 107*a* and a valve stopper 107*b* are fixed to the base plate 102*a* of the fixed scroll 102 by a bolt 107*c*, wherein the valve 107*a* is a check valve of a reed valve type for preventing the pumped out refrigerant from flowing back to the working chamber V from the high pressure chamber 104, and the stopper 107*b* is a plate for limiting the movement of the reed valve 107*a*.

A spool 107*d* is a valve for opening and closing the passage 106 (also referred to as the inlet port 106) and an electromagnetic valve 107*e* is a control valve for controlling pressure in a back pressure chamber 107*f* by controlling a communication of the back pressure chamber 107*f* with the high pressure chamber 104 or a space on a side of the low pressure port 111. A spring 107*g* is disposed in the back pressure chamber 107*f* to urge the spool 107*d* in a direction to close the inlet port 106, and an orifice 107*h* having a certain flow resistance is formed in the passage connecting the high pressure chamber 104 with the back pressure chamber 107*f*.

When the electromagnetic valve 107*e* is opened, the back pressure chamber 107*f* is communicated to the space defined by the stator housing 230 (the lower pressure side), then the pressure in the back pressure chamber 107*f* will be decreased lower than that in the high pressure chamber 104 and finally the spool 107*d* will be moved against the spring force of the spring 107*g* in a direction to open the inlet port 106. Since the pressure drop at the orifice 107*h* is so high that an amount of the refrigerant flowing from the high pressure chamber 104 into the back pressure chamber 107*f* is negligible small.

On the other hand, when the electromagnetic valve 107*e* is closed, the pressure in the back pressure chamber 107*f* becomes equal to that in the high pressure chamber 104 and then the spool 107*d* will be moved in the direction to close the inlet port 106. As above, the spool 107*d*, the electromagnetic valve 107*e*, the back pressure chamber 107*f* and the orifice 107*h* constitute a pilot-type electric valve for opening and closing the inlet port 106.

The transmission device 400 comprises a sun gear 401 provided at a center of the device 400, a planetary carrier 402 having multiple pinion gears 402*a* which move around the sun gear 401 and rotate on their own axes, and a ring-shaped internal gear (ring gear) 403 provided at outer peripheries of the pinion gears 402*a*.

The sun gear 401 is integrally formed with the rotor 220 of the electric rotating device 200, the planetary carrier 402 is integrally fixed to a shaft 331 to which the friction plate 330 is connected, and the ring gear 403 is connected to the shaft 108.

A one-way clutch 500 transmits a rotational force from the pulley 310 to the shaft 331 only in one rotational direction (a rotational direction of the pulley 310), a bearing 332 rotationally supports the shaft 331, a bearing 404 rotationally supports the sun gear 401, namely the rotor 220 with respect to the shaft 331, a bearing 405 rotationally supports the shaft 331 (the planetary carrier 402) with respect to the shaft 108, and a bearing 108*b* rotationally supports the shaft 108 with respect to the middle housing 101.

A rip seal 333 is a seal for preventing the refrigerant from flowing out of the stator housing 230 through a gap between the shaft 331 and the stator housing 230.

Now, an operation of the fluid machine 10 as described above will be explained.

(1. Pump Mode Operation)

The pump mode operation is the operation in which a rotational force is applied to the shaft 108 and the expansion-and-compressor device 100 is thereby operated to compress the refrigerant by rotating the movable scroll 103 with the orbit motion.

Namely, the ON-OFF valve 34 is opened while the liquid pump 32 is maintained at its non-operation, and the engine cooling water is prevented by the switching valve 21 from flowing through the heating device 30. Furthermore, the inlet port 106 is closed by the spool 107*d* as a result of closing the electromagnetic valve 107*e*. And the shaft 108 is rotated under the above condition.

Accordingly, as in the same manner to a well known scroll compressor, the expansion-and-compressor device 100 (also simply referred to as the compressor device 100) sucks the refrigerant from the low pressure port 111, compresses the refrigerant by the working chambers V, pumps out the pressurized refrigerant to the high pressure chamber 104 through the discharge port 105, and finally discharges the high pressure refrigerant to the heat radiating device (condenser) 11 through the high pressure port 110.

In this operation, there are two methods for applying the rotational force to the shaft 108, namely one of them is a method in which the compressor device 100 is mechanically connected to the engine 20 over the electromagnetic clutch 300, and thereby the driving force from the engine 20 is applied to the compressor device 100. And in the other method, the supply of the electric power to the electromagnetic clutch 300 is cut off and thereby the compressor device 100 is mechanically disconnected from the pulley 310 and then the electric rotating device 200 is operated as the electric motor by supplying the electric power thereto so that the rotational force of the device 200 will be applied to the compressor device 100.

In the case that the electromagnetic clutch 300 is supplied with the electric power to mechanically connect the compressor device 100 with the engine 20 and to transmit the rotational force from the engine 20 to the compressor device 100, the electric power is also supplied to the electric rotating device 200 to generate electromagnetic force at the stator and thereby to apply a torque to the rotor 220 so that the sun gear 401 and the rotor 220 may not be rotated.

Figure 3:
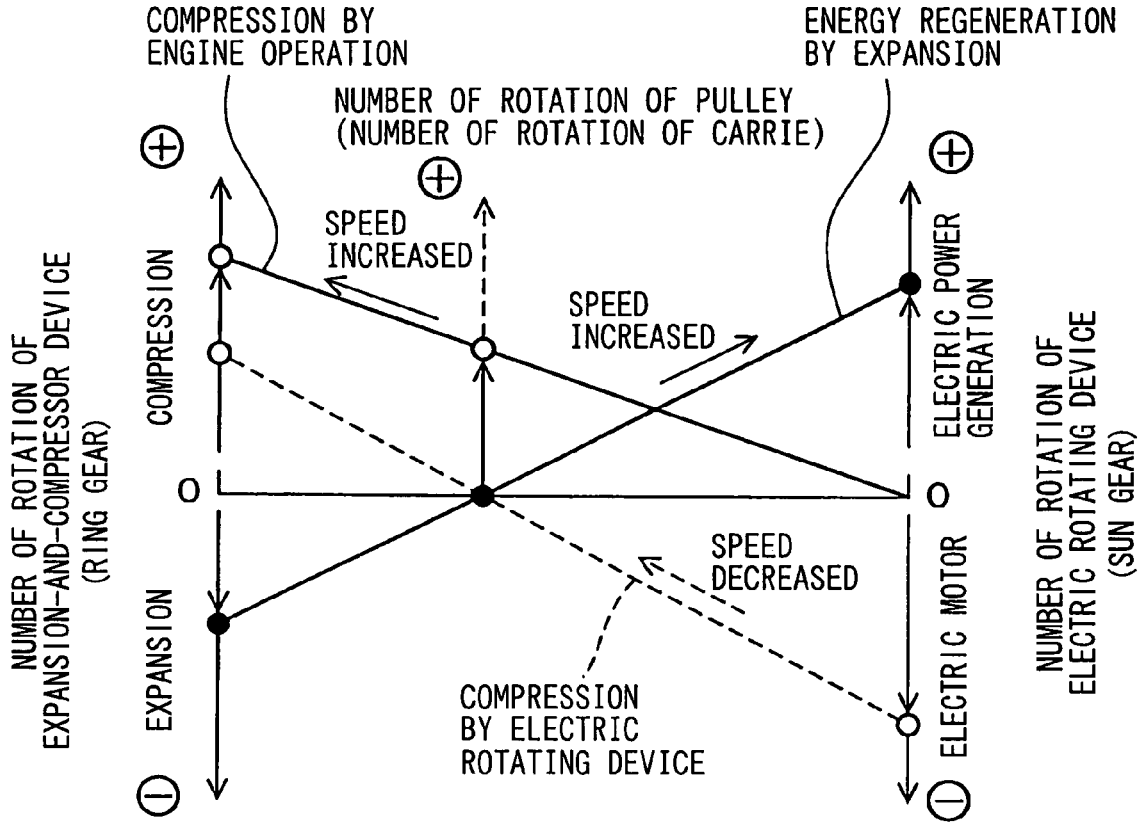
FIG. 3 is a chart showing an operation of the fluid machine according to the first embodiment.

As a result, the rotational force transmitted from the engine 20 to the pulley 310 will be further transmitted to the compressor device 100 through the transmission device 400 with the rotational speed being increased thereby (please refer to "compression by engine operation" in FIG. 3).

In the case that the compressor device 100 is disconnected from the engine 20 by the electromagnetic clutch 300 and the rotational force is applied by the electric rotating device 200, the supply of the electric power to the electromagnetic clutch 300 is cut off while the electric power is supplied to the electric rotating device 200 to rotate the rotor 220 in a direction opposite to the pulley rotation and thereby the compressor device 100 is operated as the compressor.

In this operation, since the shaft 331 (the planetary carrier 402) is not rotated because of the one-way clutch 500, the rotational force of the electric rotating device 200 will be transmitted to the compressor device 100 through the transmission device 400 with the rotational speed being reduced thereby (please also refer to "compression by electric rotating device" in FIG. 3).

The refrigerant discharged from the high pressure port 110 is circulated in the refrigerating cycle, which comprises the heating device 30, the ON-OFF valve 34, the heat radiating device (condenser) 11, the gas-liquid separator (receiver) 12, the expansion valve (depressurizing device) 13, the evaporator 14, the check valve 14*a* and the low pressure port 111 of the compressor device 100, wherein a cooling operation by the heat absorption at the evaporator 14 (or a heating operation by the heat radiation at the heat radiating device 11) will be performed. Since the engine cooling water does not flow through the heating device 30, the refrigerant is not heated at the heating device 30, which operates just as a part of the refrigerant passage in this operation mode.

2. Motor Mode Operation

The motor mode operation is the operation in which high pressure and superheated steam of the refrigerant, which is superheated by the heating device 30, is introduced into the expansion-and-compressor device 100 and the refrigerant is expanded in the working chambers V, so that a rotational force is generated by rotating the movable scroll 103 with the orbit motion in the different rotational direction to that for the pump mode operation. In this operation, the expansion-and-compressor device 100 is also referred to as the expansion device 100.

The rotational force generated at the expansion device 100 is used for rotating the rotor 220 to generate the electric power at the electric rotating device 200, and the generated electric power will be charged into a battery.

The electric rotating device 200 is also referred to as an energy regenerating device for converting the kinetic energy generated at the expansion device 100 into the electric power.

Namely, the ON-OFF valve 34 is closed and the liquid pump 32 is operated, and the engine cooling water is circulated into the heating device 30 by the switching valve 21. Furthermore, the inlet port 106 is opened by the spool 107*d* as a result of opening the electromagnetic valve 107*e*, so that the high pressure superheated refrigerant heated by the heating device 30 and supplied into the high pressure chamber 104 is introduced into the working chambers V through the inlet port 106 to expand the refrigerant therein.

The movable scroll 103 will be rotated in the reversed direction to that of the pump mode operation by the expansion of the superheated steam. The rotational energy given to the movable scroll 103 is transmitted to the rotor 220 of the electric rotating device 200 through the transmission device 400 with the rotational speed being increased thereby. The refrigerant gas, the pressure of which is reduced after the expansion, flows out through the low pressure port 111 to the heat radiating device 11.

In the above operation, since the shaft 331 (the planetary carrier 402) is not rotated because of the one-way clutch 500, the rotational force of the movable scroll 103 is transmitted to the electric rotating device 200 through the transmission device 400 with the rotational speed being increased (please also refer to "energy regeneration by expansion" in FIG. 3).

The refrigerant flowing out from the low pressure port 111 is circulated in Rankine cycle, which comprises the second bypass passage 33, the check valve 33*a*, the heat radiating device 11, the gas-liquid separator 12, the check valve 31*a*, the first bypass passage 31, the liquid pump 32, the heating device 30, and the high pressure port 110 of the expansion device 100. The liquid pump 32 pushes the liquid-phase refrigerant into the heating device 30 at such a pressure, at which the superheated refrigerant heated at the heating device 30 may not flow back to the gas-liquid separator 12.

Figure 4:
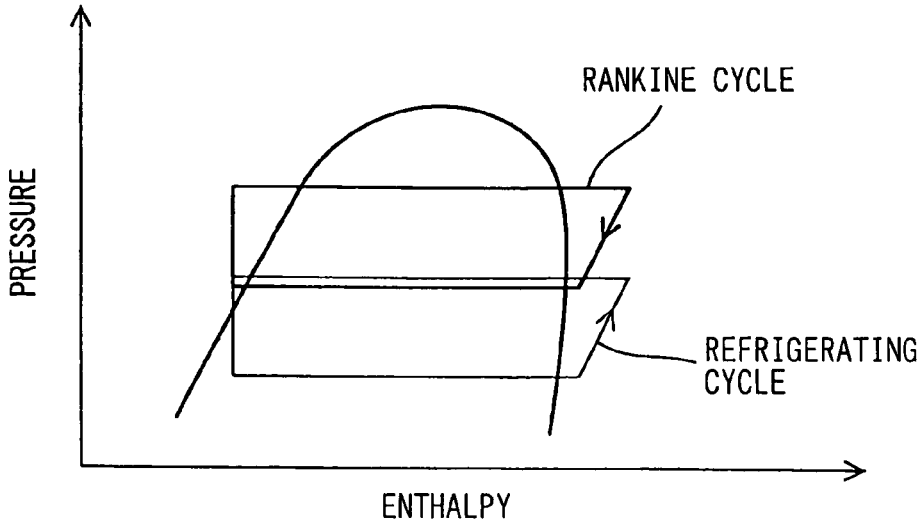
FIG. 4 is a pressure-enthalpy diagram showing conditions of refrigerant in the pump mode and motor mode operations.

In the above expansion-and-compressor device 100, in which the expansion device and the compressor device are commonly formed and used in the refrigerating cycle having the Rankine cycle, the pressure of the refrigerant in the operation of the Rankine cycle is higher than that in the operation of the refrigerating cycle, as shown in FIG. 4.

In the case that both of the cycles are operated (for the pump mode and the motor mode) with the same circulating volume of the refrigerant, volumetric flow rate for the motor mode operation is smaller than that for the pump mode operation by the operational pressure difference (i.e. the refrigerant density becomes higher), and thereby the rotational speed of the expansion-and-compressor device 100 becomes lower in the motor mode operation. As a result, a leak speed would become higher than an expansion speed. And an influence of the leak would become higher, even when a leak space was the same. Accordingly, an optimum efficiency could be hardly obtained.

According to the present invention, however, the rotational force transmitted from the engine 20 to the electromagnetic clutch 300 is increased in its rotational speed by the transmission device 400, and transmitted to the expansion-and-compressor device 100. Accordingly, the necessary discharge amount of the compressed refrigerant can be obtained by the increased rotational speed, and thereby the discharge amount per revolution of the expansion-and-compressor device 100 can be set to a smaller amount.

The fluid machine 10 (the expansion-and-compressor device 100) can be operated in an optimum manner in response to the reduced volumetric flow rate of the refrigerant (namely, capacity of the expansion device is made smaller to operate under the optimum conditions), even when the volumetric flow rate of the refrigerant is decreased in the motor mode operation. The decrease of the rotational speed can be avoided and thereby the influence of the leak per revolution can be reduced (by making the expansion speed higher than the leak speed of the refrigerant) to finally improve the operational efficiency of the fluid machine 10.

The fluid machine 10 (the expansion-and-compressor device 100) can meet the refrigerating capacity for the pump mode operation by rotating the compressor device 100 at a higher rotational speed and at the same time improves the operating efficiency for the motor mode operation.

Since the-kinetic energy obtained by the motor mode operation is used to generate the electric power at the electric rotating device 200, and the generated electric power is charged into the battery, the waste heat from the engine 20 can be efficiently utilized.

The fluid machine 10 can be made in a small-size construction since the expansion-and-compressor device 100, the transmission device 400 and the electric rotating device 200 are arranged on the same axis, and those components are integrally housed in the housings 101, 230 and the fixed scroll 102.

OTHER EMBODIMENTS

The transmission device 400 of the planetary gear train can be replaced by any kinds of other transmission devices, such as CVT (Continuous Variable Transmission), or a toroidal-type transmission without using belts, and the like.

The expansion-and-compressor device 100 of the scroll type can be also replaced by any other type of expansion and compressor devices, such as a rotary type, a piston type, a vane type and so on.

Although the collected waste heat energy from the engine is converted into the electric power by the expansion-and-compressor device 100 and charged in the battery in the above embodiment, the collected energy can be converted into mechanical energy, for example, into kinetic energy by a flywheel, or into elastic potential energy by springs.

The fluid machine should not be limited to a use for motor vehicles.

What is claimed is:

1. A fluid machine comprising:

a housing:

a shaft supported on the housing, wherein the shaft is capable of being rotated by a driving force from a driving source;

an expansion-and-compressor device housed in the housing, the expansion-and-compressor device being capable of operating as a compressor device in a pump mode operation in which the expansion-and-compressor device is rotated by the driving force from the driving source via the shaft to compress working fluid, and of operating as an expansion device in a motor mode operation in which fluid pressure of the working fluid is converted into kinetic energy; and a transmission device housed in the housing and located between the shaft and the expansion-and-compressor device, for transmitting rotation from the shaft to the expansion-and-compressor device, the transmission device being capable of increasing the rotational speed of the expansion-and-compressor device to be transmitted from the shaft to the expansion-and-compressor device, when the expansion-and-compressor device is operated in the pump mode operation.

2. A fluid machine according to claim 1, wherein the driving source is a driving source provided outside of the fluid machine.

3. A fluid machine according to claim 1, further comprising: an energy regenerating device housed in the housing for regenerating the kinetic energy as an energy of a predetermined form.

4. A fluid machine according to claim 3, wherein the energy regenerating device is an electric rotating machine for converting the kinetic energy into an electric energy.

5. A fluid machine according to claim 3, wherein the expansion-and-compressor device, the transmission device and the energy regenerating device are coaxially arranged with each other.

6. A fluid machine according to claim 1, wherein the expansion-and-compressor device has a working chamber, and is operated as the compressor device when the working fluid is compressed, and the expansion-and-compressor device is operated as the expansion device for expanding the working fluid in the working chamber when the expansion-and-compressor device is operated in the motor mode operation to convert the fluid pressure into the kinetic energy.

7. A fluid machine according to claim 1, wherein the housing includes:

a high-pressure port provided as a working fluid introducing port from a heating device for a Rankine cycle and as a working fluid supplying port to a heat radiating device for a refrigeration cycle; and a low-pressure port provided as a working fluid supplying port to the heating radiating device for Rankine cycle and as a working fluid introducing port from an evaporator for the refrigeration cycle, and wherein the fluid machine further comprises a valve mechanism that enables flow of the working fluid from the expansion-and-compressor device to the high-pressure port in the pump mode operation and that enables flow of the working fluid from the high-pressure port to the expansion-and-compressor device.

8. A fluid machine according to claim 6, wherein the expansion-and-compressor device has a relatively small volume of working chambers that is designed to perform a sufficient refrigerating operation of the refrigeration cycle under an increased rotational speed transmitted by the transmission device in the pump mode operation.

9. A fluid machine according to claim 8, wherein the transmission device is a planetary mechanism including a sun gear, a planetary pinion gears, and a ring gear, and wherein the fluid machine further comprises an electric rotating machine for converting between kinetic energy and electric energy, and wherein the electric rotating machine is operatively connected with the planetary mechanism to be driven by the expansion-and-compressor device in the motor mode operation.

10. A fluid machine according to claim 9, wherein the electric rotating machine is operatively connected with the planetary mechanism to make the planetary mechanism drive the expansion-and-compressor device with an increased rotational speed relative to the rotational speed of the shaft in the pump mode operation.

* * * * *